US005927945A

United States Patent [19]

Chen

[11] Patent Number: 5,927,945

[45] Date of Patent: Jul. 27, 1999

[54] ASSEMBLING DEVICE FOR BLADE OF HANGING FAN

[76] Inventor: Shang Wan Chen, No. 65, Sec. 3, Chung Shan Rd., Tan Tzu Hsiang, Tai Chung Hsien, Taiwan

[21] Appl. No.: 09/215,232

[22] Filed: Dec. 18, 1998

[51] Int. Cl.[6] ..... F01D 5/30; F01D 25/28; F03B 3/12; B04C 11/04

[52] U.S. Cl. ..... 416/5; 416/5; 416/210 R; 416/219 A; 416/214 R; 416/220 A

[58] Field of Search ..... 416/5, 210 R, 416/214 R, 219 A, 220 A

[56] References Cited

U.S. PATENT DOCUMENTS

| | | | |
|---|---|---|---|
| 4,850,799 | 7/1989 | Bucher, Sr. et al. | 416/134 |
| 5,354,177 | 10/1994 | Chang | 416/219 A |
| 5,476,366 | 12/1995 | Weihsmann | 416/220 A |
| 5,873,701 | 2/1999 | Shiu | 416/205 |

*Primary Examiner*—F. Daniel Lopez
*Assistant Examiner*—Rhonda Barton
*Attorney, Agent, or Firm*—Rosenberg, Klein & Bilker

[57] ABSTRACT

An assembling device for the blade of the hanging fan which comprises a ring body arranged on the bottom of the motor unit and having a plurality of dovetail grooves on rim thereof, and blade base has corresponding dovetail shape such that the blade base can be inserted into the dovetail groove and the blades are fixed.

3 Claims, 6 Drawing Sheets

ASSEMBLING DEVICE FOR BLADE OF HANGING FAN

FIELD OF THE INVENTION

The present invention relates to an assembling device for blade of the hanging fan, by which the blade can be more conveniently assembled to the hanging fan.

BACKGROUND OF THE INVENTION

The conventional hanging fan generally comprises a motor unit and a plurality of blades. The assembling way of the blades can be classified into shaft type or case type. As to the shaft type, the blades are arranged on the blade rack on the bottom of motor shaft, and are driven by shaft. As to the case type, the blades are arranged on the blade rack on the bottom of motor case, and are driven by the case.

However, in both mentioned arrangement, the motor unit, blade rack and blade are generally stored and conveyed separately because their size awe bulky. After those components are conveyed to the place for assembling they are generally assembled by bolt. The assembling task is troublesome and time consuming. A hanging fan with quickly and easily assembled blade is desired.

It is the object of the present invention to provide an assembling device for the blade of the hanging fan which comprises a ring body arranged on the bottom of the motor unit and having a plurality of dovetail grooves on rim thereof, and blade base has corresponding dovetail shape such that the blade base can be inserted into the dovetail groove and the blades are fixed.

The various objects and advantages of the present invention will be more readily understood from the following detailed description when read in conjunction with the appended drawing, in which:

DETAILED DESCRIPTION OF PREFERRED EMBODIMENT

Figure 1:
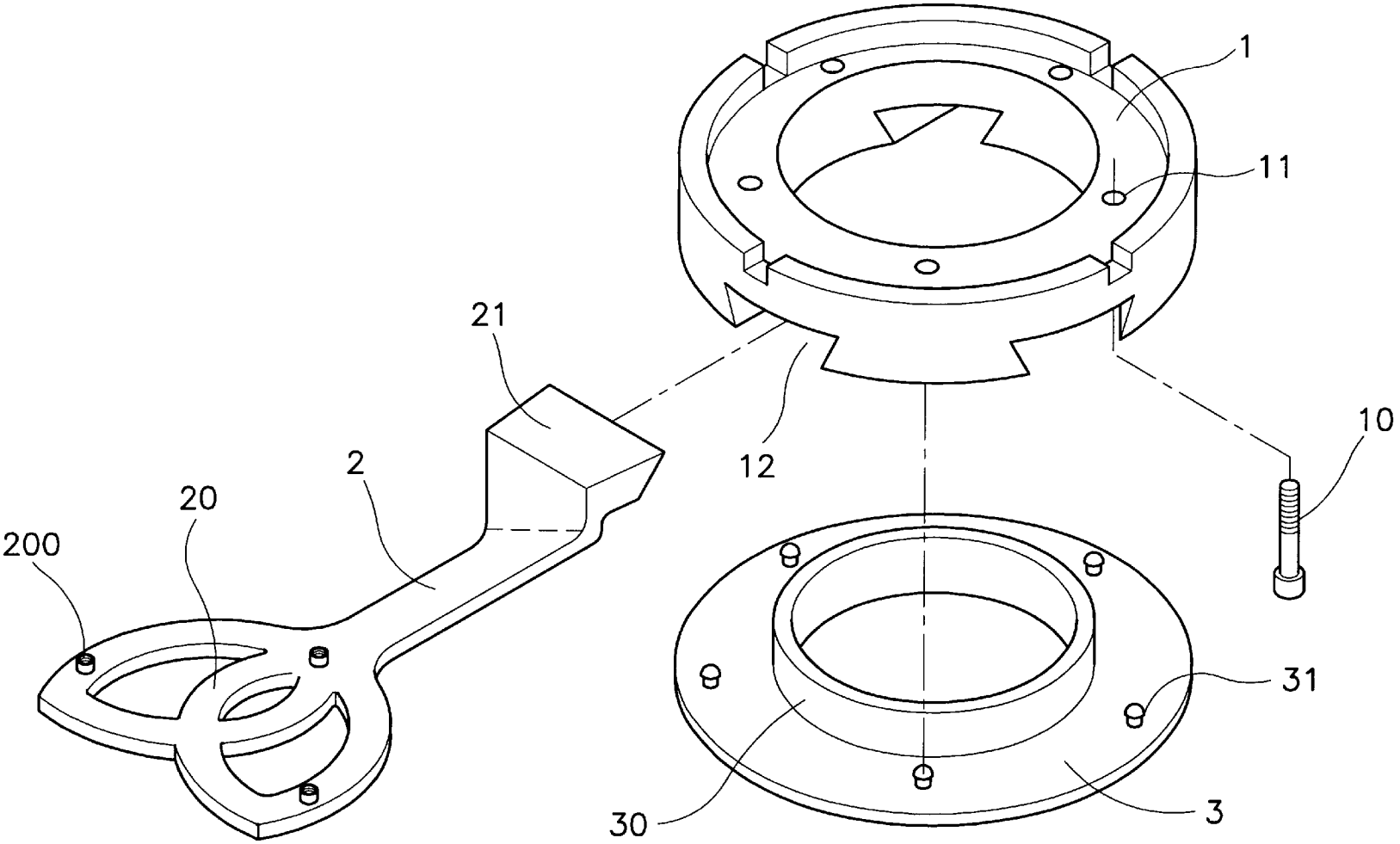
FIG. 1 is the exploded view of the first embodiment of the present invention.
Figure 2:
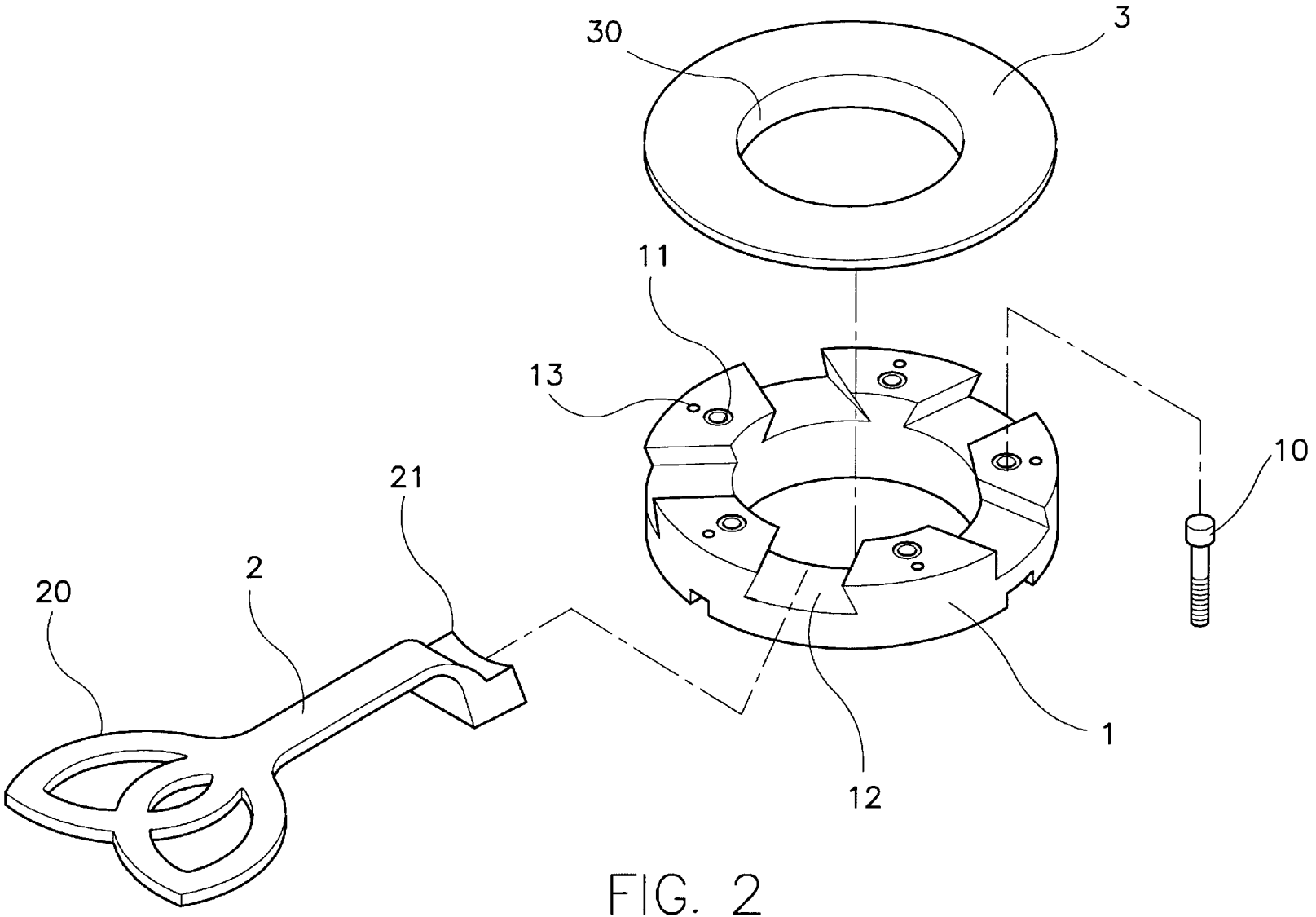
FIG. 2 is the back exploded view of the first embodiment of the present invention.
Figure 3:
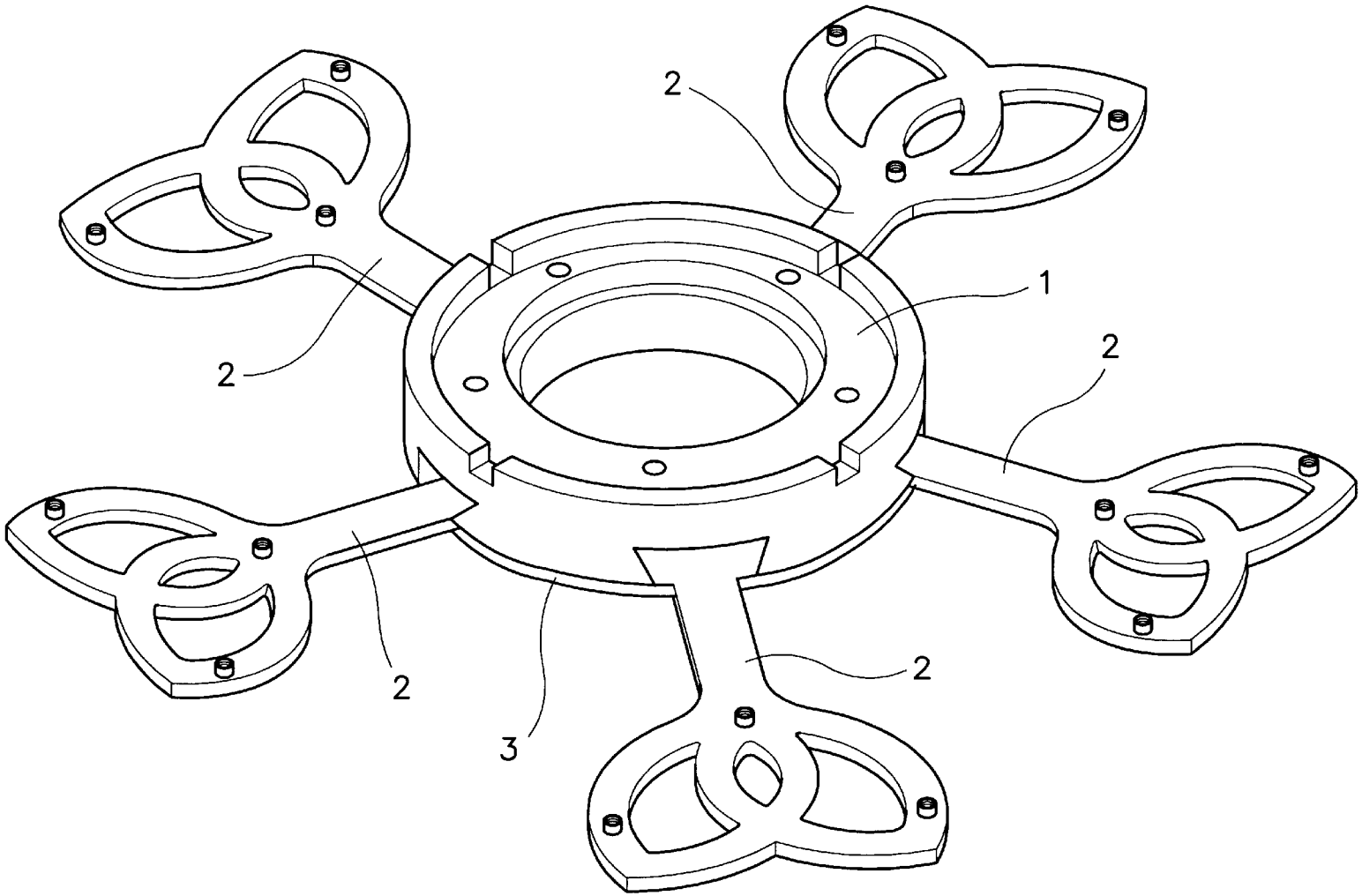
FIG. 3 is the perspective view of the first embodiment of the present invention.
Figure 4:
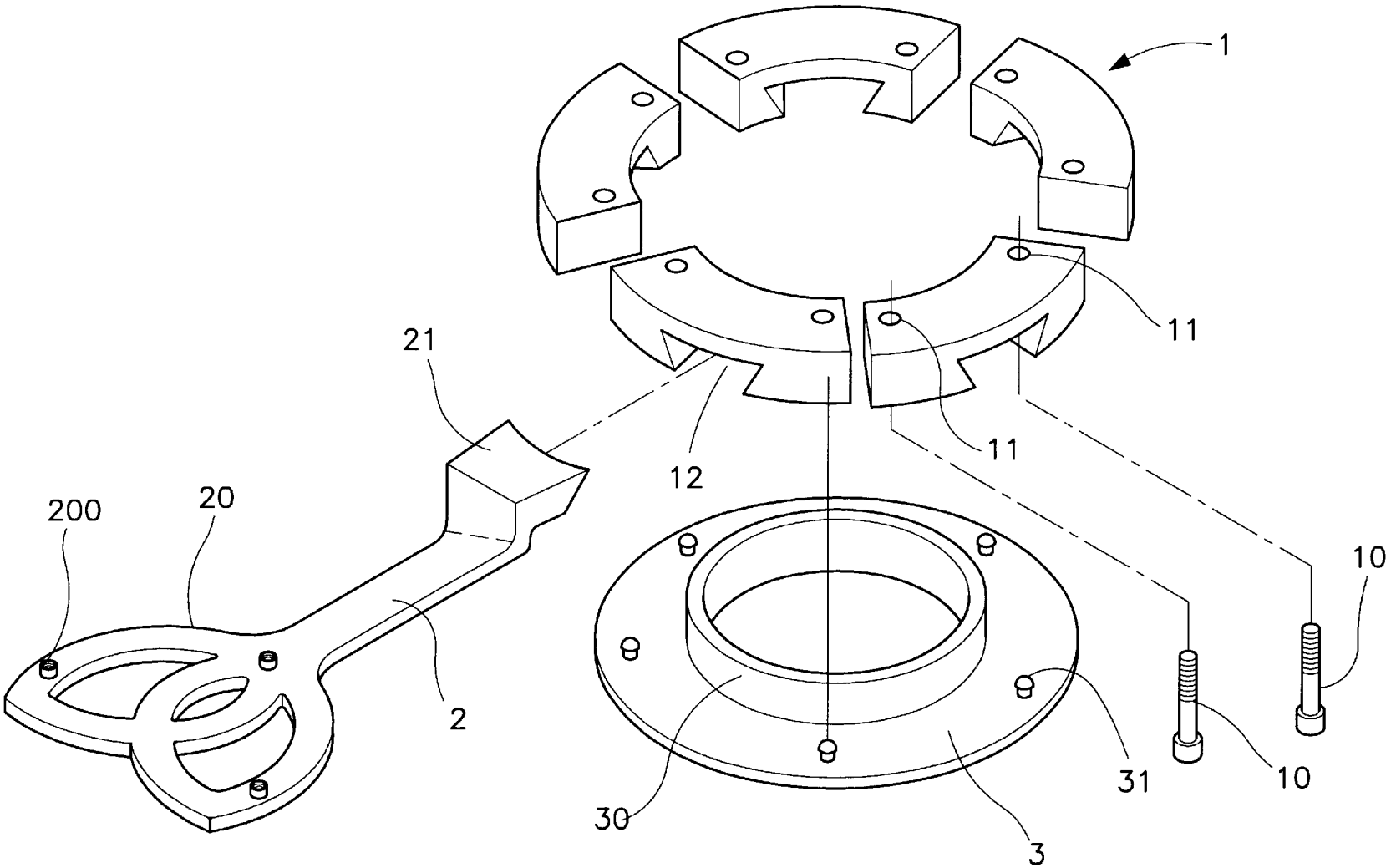
FIG. 4 is the exploded view of the second embodiment of the present invention.
Figure 5:
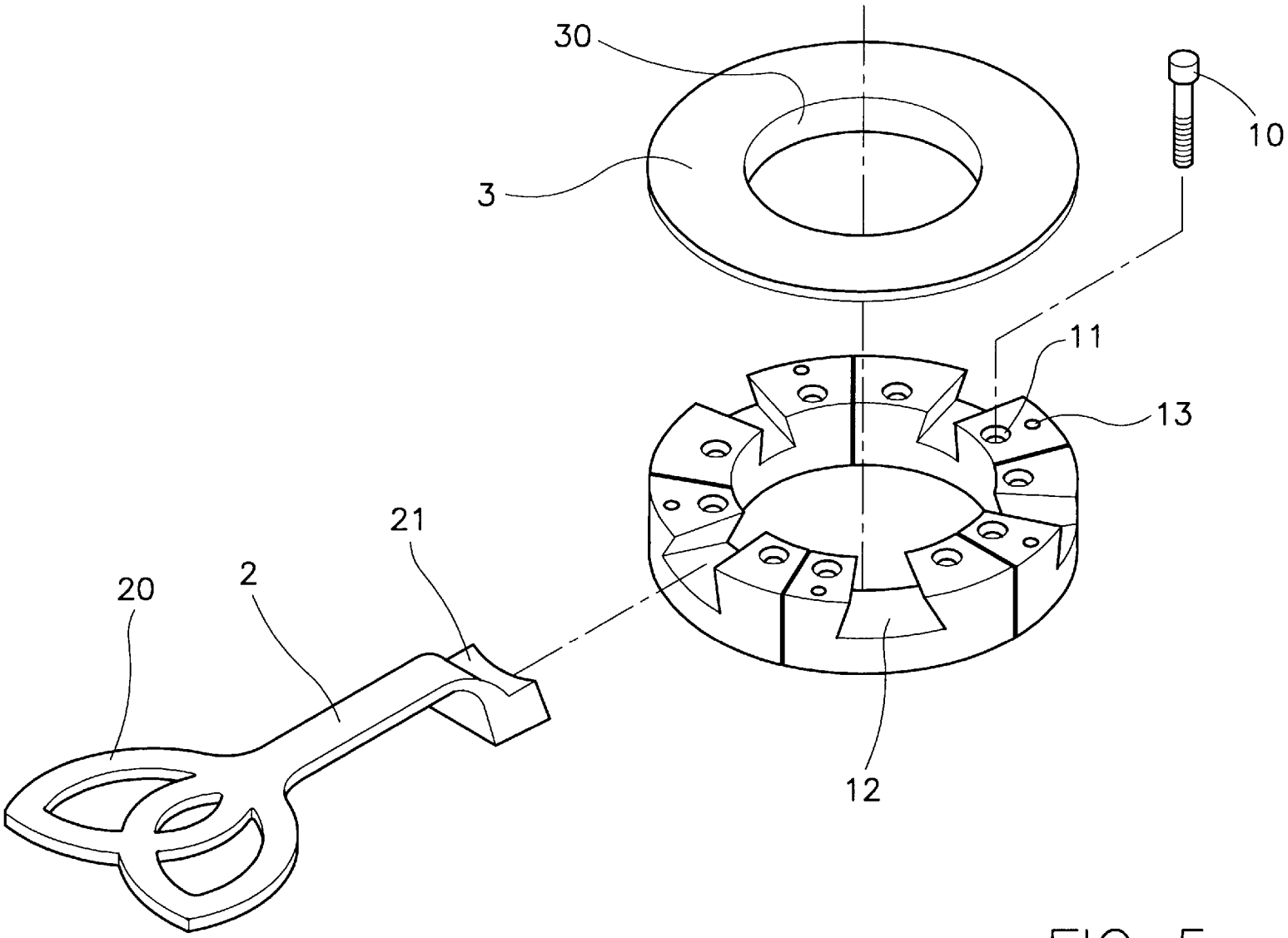
FIG. 5 is the back exploded view of the second embodiment of the present invention.
Figure 6:
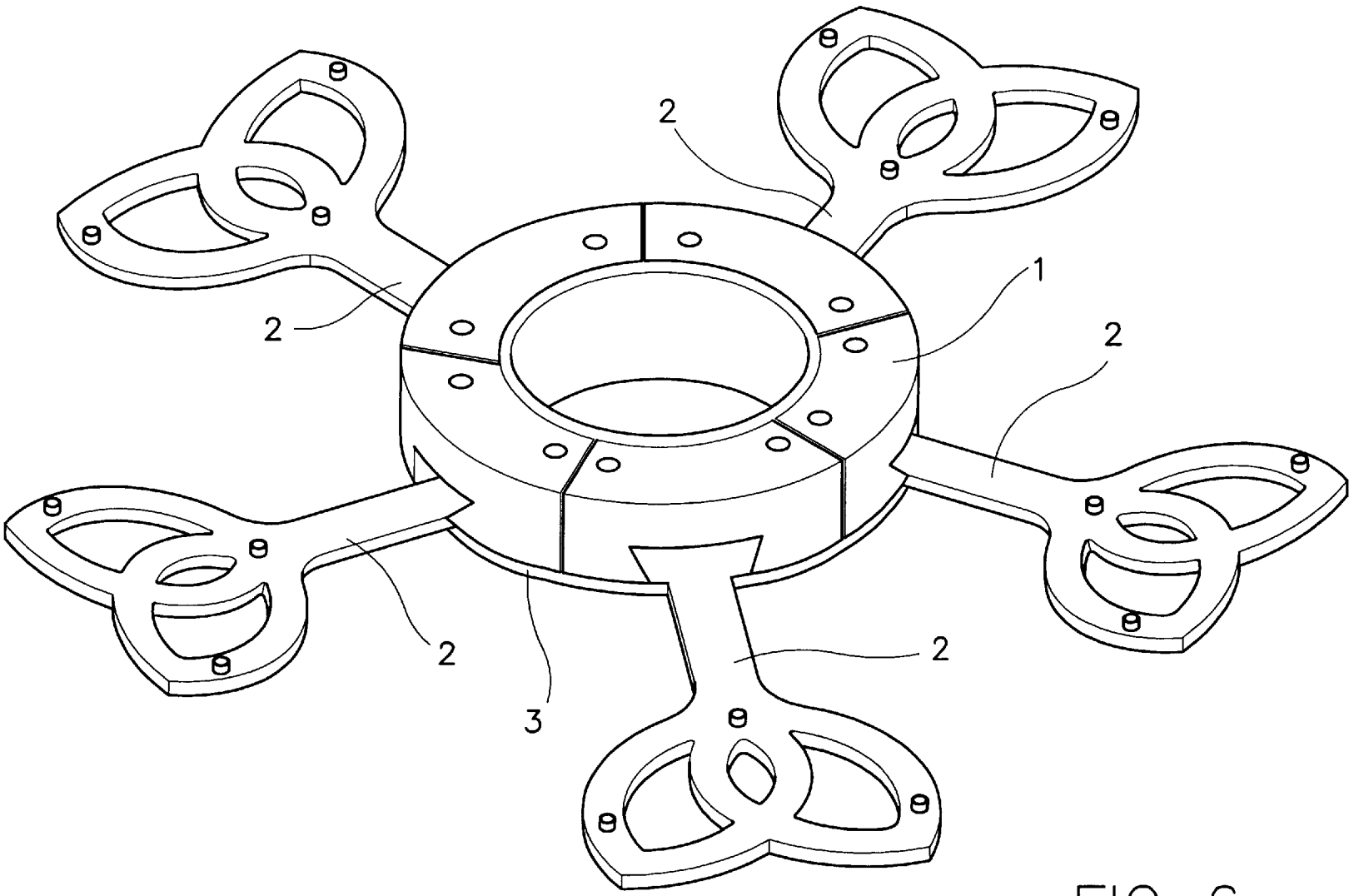
FIG. 6 is the perspective view of the second embodiment of the present invention.

As shown in FIGS. 1 to 3, an assembling device according to the first embodiment of the present invention is depicted. The inventive assembling device is arranged on the bottom side of the hanging fan and comprises a ring body 1, a predetermined plurality number of blade racks 2 and a cover 3. The ring body 1 is locked to the bottom of the motor unit by screwing bolt 10 through the thread hole 11 thereof. The ring body 1 has a plurality of radially-extending and taper-shaped dovetail grooves 12 on the rim thereof. Each groove 12 has wider side along the top side and inner side thereof. The ring body 1 further comprises a plurality of positioning holes 13 on the predetermined bottom position thereof. Moreover, as shown in FIGS. 1–3 depicting the first embodiment of the invention, the ring body 1 can be of an integrally annular shape. As shown in FIGS. 4–6 depicting the second embodiment of the invention, the ring body 1 comprises a plurality of arc-shaped sub-rings, and each sub-ring is provided with an above-mentioned dovetail groove 12.

The blade rack 2 has a coupling part 20 on outer side thereof, and the coupling part 20 has thread hole 200 for the assemble of blade by bolt.

The blade rack 2 has root part 21 on the inner side thereof, which is of dovetail shape corresponding to that of dovetail groove 12.

The cover 3 is made of flexible material such as rubber and can cover the bottom surface of the ring body. The cover 3 has a projecting loop 30 on the inner portion thereof. The outer diameter of the projecting loop 30 is slightly larger than the inner diameter of the ring body 1. A plurality of positioning pins 31 are provided between the projecting loop 30 and the rim of the cover 3.

During the assembling process, because the ring body 1 is locked to the shaft or case of the motor unit initially, the user only need to assemble the blade rack. Each blade rack 2 is insetted into the corresponding dovetail groove 12 of the ring body 1 and dragged outward. Because the blade rack 2 and the dovetail groove 12 are of taper shape with wider top and inner side, the blade rack 2 will not release downwardly of outwardly from the dovetail groove 12.

Afterward, the cover 3 is used to cover the bottom of the ring body 1 with the projecting loop 30 faces upwardly. The flexibility of the projecting loop 30 faces upwardly. The flexibility of the projecting loop 30 allows it to insert into the inner ring of the ring body 1 and prevent the blade rack from releasing inwardly. Moreover, the positioning pins 31 are inserted into the positioning hole such that the cover 3 can be firmly attached to the bottom side of the ring body 1. In other word, the user only need to put the blade rack 2 into the dovetail groove 12 and drag the blade rack 2 outwardly, as well as attach the cover 3 on the bottom side of the ring body 1, the assembling of blade rack can be easily executed.

Although the present invention has been described with reference to the preferred embodiment thereof, it will be understood that the invention is not limited to the details thereof. Various substitutions and modifications have suggested in the foregoing description, and others will occur to those of ordinary skill in the at. Therefore, all such substitutions and modifications are intended to be embraced within the scope of the invention as defined in the appended claims.

I claim:

1. An mounting device for blade racks of a hanging fan, comprising:

a ring body arranged on the bottom side of the motor unit of said fan, having a plurality of radially-extending and taper-shaped dovetail grooves on the rim thereof, the top and inner side of the groove having wider width;

said blade racks having same dovetail shape corresponding to that of said dovetail groove such that the blade racks are inserted into said dovetail grooves;

a cover attached to bottom side of the ring body and having a projecting loop on upper surface thereof, said projecting loop on upper surface thereof, said projecting loop inserting to the inner ring of said ring body to prevent the inward release of said blade rack.

2. The device as in claim 1, wherein said ring body has a plurality of positioning holes on the bottom surface thereof and said cover has a plurality of positioning pins on location corresponding to said positioning holes by which said ring body and cover can be assembled.

3. The device as in claim 1, wherein said ring body can be divided to a plurality of arc-shaped sub-ring and each sub-ring has one said dovetail groove.

* * * * *